US009017145B2

(12) United States Patent
Kurosawa et al.

(10) Patent No.: US 9,017,145 B2
(45) Date of Patent: Apr. 28, 2015

(54) POLISHING SOLUTION DISTRIBUTION APPARATUS AND POLISHING APPARATUS HAVING THE SAME

(75) Inventors: Yoshiaki Kurosawa, Tokyo (JP); Tomohiro Hashii, Tokyo (JP); Yuichi Kakizono, Tokyo (JP)

(73) Assignee: Sumco Corporation, Tokyo (JP)

( * ) Notice: Subject to any disclaimer, the term of this patent is extended or adjusted under 35 U.S.C. 154(b) by 271 days.

(21) Appl. No.: 13/083,833

(22) Filed: Apr. 11, 2011

(65) Prior Publication Data

US 2011/0263183 A1 Oct. 27, 2011

(30) Foreign Application Priority Data

Apr. 26, 2010 (JP) ..... 2010-100922

(51) Int. Cl.

| | |
|---|---|
| ***B24B 57/00*** | (2006.01) |
| ***B24B 29/02*** | (2006.01) |
| ***B24B 37/08*** | (2012.01) |
| ***B24B 57/02*** | (2006.01) |

(52) U.S. Cl.

CPC ..... *B24B 37/08* (2013.01); *B24B 57/02* (2013.01)

(58) Field of Classification Search

CPC ..... B24B 37/08; B24B 57/02
USPC ..... 451/64, 446; 222/330, 478, 185.1, 926
See application file for complete search history.

(56) References Cited

U.S. PATENT DOCUMENTS

| | | | | |
|---|---|---|---|---|
| 3,099,373 | A * | 7/1963 | Gandrud | 222/527 |
| 4,491,246 | A * | 1/1985 | Dooley | 222/129 |
| 4,819,843 | A * | 4/1989 | Nakayama | 224/553 |
| 5,489,055 | A * | 2/1996 | Levy | 224/544 |
| 5,509,848 | A * | 4/1996 | Shimbara | 451/24 |
| 5,664,718 | A * | 9/1997 | Vine | 224/545 |
| 5,803,798 | A * | 9/1998 | Cesna et al. | 451/269 |
| 5,980,366 | A * | 11/1999 | Waddle et al. | 451/262 |
| 6,045,437 | A * | 4/2000 | Tandon et al. | 451/288 |

(Continued)

FOREIGN PATENT DOCUMENTS

| | | |
|---|---|---|
| JP | 47-43116 | 12/1972 |
| JP | 58-191957 | 12/1983 |

(Continued)

OTHER PUBLICATIONS

English Translation of JP 11262862 A.*

(Continued)

*Primary Examiner* — Joseph J Hail
*Assistant Examiner* — Marc Carlson
(74) *Attorney, Agent, or Firm* — Greenblum & Bernstein, P.L.C.

(57) ABSTRACT

The present invention provides a polishing solution distribution apparatus capable of reducing distribution deviation of polishing solution even when leveling for installation is insufficient or inclination of an installation location varies and a polishing apparatus having the same. The polishing solution distribution apparatus includes a cone-shaped branch body in which a solution pan to store supplied polishing solution is formed and in which plural flow passages radially connected to a side face of the solution pan respectively and having a delivery port to supply polishing solution to a position lower than the connected position are formed, a support portion to support the branch body, and a universal joint mechanism to support the branch body via the support portion at a position being higher than the gravity center of the branch body.

18 Claims, 5 Drawing Sheets

(56) References Cited

U.S. PATENT DOCUMENTS

| | | | | |
|---|---|---|---|---|
| 6,149,506 | A * | 11/2000 | Duescher | 451/59 |
| 6,196,907 | B1 * | 3/2001 | Kahn | 451/446 |
| 6,206,767 | B1 * | 3/2001 | Suzuki et al. | 451/262 |
| 6,311,966 | B1 * | 11/2001 | Morishita et al. | 269/21 |
| 6,406,364 | B1 * | 6/2002 | Kimura et al. | 451/446 |
| 6,527,624 | B1 * | 3/2003 | Tolles et al. | 451/41 |
| 6,645,862 | B2 * | 11/2003 | Wenski et al. | 438/691 |
| 6,939,210 | B2 * | 9/2005 | Polyak et al. | 451/60 |
| 7,163,438 | B2 * | 1/2007 | Maury et al. | 451/8 |
| 7,185,788 | B2 * | 3/2007 | Morris | 222/129 |
| 7,217,175 | B2 * | 5/2007 | Togawa | 451/63 |
| 7,297,047 | B2 * | 11/2007 | Lee et al. | 451/5 |
| 7,485,029 | B2 * | 2/2009 | Kanda et al. | 451/267 |
| 7,695,350 | B2 * | 4/2010 | Mase et al. | 451/99 |
| 7,727,053 | B2 * | 6/2010 | Ueno et al. | 451/41 |
| 2002/0115387 | A1 * | 8/2002 | Wenski et al. | 451/41 |
| 2004/0007591 | A1 * | 1/2004 | Sut | 222/129 |
| 2005/0032469 | A1 * | 2/2005 | Duescher | 451/548 |
| 2007/0049166 | A1 * | 3/2007 | Yamaguchi et al. | 451/5 |
| 2007/0184757 | A1 * | 8/2007 | Kume et al. | 451/28 |
| 2007/0212988 | A1 * | 9/2007 | Nabeya et al. | 451/287 |
| 2008/0057831 | A1 * | 3/2008 | Kanda et al. | 451/7 |
| 2010/0062691 | A1 * | 3/2010 | Togawa et al. | 451/53 |
| 2010/0197197 | A1 * | 8/2010 | Nakayoshi et al. | 451/5 |
| 2011/0064971 | A1 * | 3/2011 | Kimura et al. | 428/846.9 |
| 2011/0223836 | A1 * | 9/2011 | Duescher | 451/28 |
| 2012/0028545 | A1 * | 2/2012 | Duescher | 451/28 |

FOREIGN PATENT DOCUMENTS

| | | | | |
|---|---|---|---|---|
| JP | 2005-176170 | | 6/1999 | |
| JP | 11262862 | A * | 9/1999 | B24B 57/02 |
| JP | 2001-088020 | | 4/2001 | |
| JP | 2001088020 | A * | 4/2001 | B24B 37/00 |
| JP | 2002-355752 | | 12/2002 | |
| JP | 2002355752 | A * | 12/2002 | B24B 37/04 |
| JP | 2006-150507 | | 6/2006 | |
| JP | 2006150507 | A * | 6/2006 | |
| JP | 2007-168009 | | 7/2007 | |
| WO | WO 2007010717 | A1 * | 1/2007 | |

OTHER PUBLICATIONS

JP2001-088020A—Machine Translation of Japanese Patent into English.*

JP2002-355752A—Machine Translation of Japanese Patent into English.*

Japanese Office Action for Japanese Application No. 2010-100922 dated Dec. 25, 2013.

* cited by examiner

POLISHING SOLUTION DISTRIBUTION APPARATUS AND POLISHING APPARATUS HAVING THE SAME

BACKGROUND OF THE INVENTION

1. Field of the Invention

The present invention relates to a polishing solution distribution apparatus to distribute polishing solution for polishing a workpiece such as a silicon wafer for a semiconductor and a polishing apparatus having the same.

2. Description of the Related Art

In general, a silicon wafer for a semiconductor is to be shipped as a product through respective processes of lapping, etching, polishing, cleaning and inspecting after being cut out from an ingot by utilizing a diamond saw, a wire saw and the like. In the polishing process, a carrier which holds a workpiece being a polishing object is placed between a circular upper platen and a circular lower platen. Then, spinning and revolving of the carrier are performed while the upper and lower platens or only the lower platen is rotated as pouring polishing solution into an area sandwiched by the upper platen and the lower platen via a polishing solution supply hole arranged at the upper platen. Accordingly, upper and lower faces of the workpiece are polished.

In such a polishing process, it is important to improve processing accuracy of a workpiece as eliminating deviation of wear of a platen face by evenly distributing polishing solution to an area sandwiched by an upper platen and a lower platen.

Examples of a method to distribute polishing solution in the related art include a separate valve type having plural branch piping to adjust flow quantity of respective branch piping with separate valves, a pump supply type to adjust flow quantity with a proportioning pump, and a dropping type to distribute polishing solution dropping to a distributor with plural branch piping. With the separate valve type, it is difficult to adjust the flow quantity of each branch piping with adjustment of the separate valve and the adjustment operation is troublesome since the valves are arranged at a high location. With the pump supplying type, cost is increased since the pump is expensive. Accordingly, in general, the dropping type is adopted as disclosed in Japanese Patent Application Laid-Open No. 2005-186170, Japanese Utility Model Application Laid-Open No. 58-191957, Japanese Utility Model Application Laid-Open No. 47-43116, and the like.

Japanese Patent Application Laid-Open No. 2005-186170 discloses that distribution deviation of polishing solution is lessened by placing a sphere body at a funnel-shaped solution receiving portion to which polishing solution drops and adjusting flow quantity of the polishing solution with buoyancy force of the sphere body. Japanese Utility Model Application Laid-Open No. 58-191957 discloses a polishing apparatus in which upper and lower platens perform rotational motions to supply powder to a polishing face of the platen through plural tubes from a powder ring with a concave groove. Japanese Utility Model Application Laid-Open No. 47-43116 discloses a polishing apparatus in which equal quantity of polishing solution flows to each discharge port arranged at a distributor as filling sponge body into the distributor so that polishing solution dropping to the sponge body soaks throughout the sponge body.

With the above dropping type in the related art, there has been a problem that polishing solution cannot be evenly distributed when leveling for distributor installation is insufficient or inclination of an installation location varies after installation. Further, in Japanese Patent Application Laid-Open No. 2005-186170, there has been a problem that particles contained in polishing solution are solidified as a result of stagnant flow of polishing solution depending on weight of the sphere body. In Japanese Utility-model 47-43116, there also has been a problem that particles contained in polishing solution stagnate and are hardened at the sponge body.

SUMMARY OF THE INVENTION

To address the above issues, the present invention provides a polishing solution distribution apparatus capable of reducing deviation of distribution of polishing solution even when leveling for installation is insufficient or inclination of an installation location varies and a polishing apparatus having the same.

Further, the present invention provides a polishing solution distribution apparatus capable of distributing polishing solution without solidification of particles contained in polishing solution due to stagnant flow of polishing solution and a polishing apparatus having the same.

A polishing solution distribution apparatus according to the present invention includes: a branch body in which a solution pan to store supplied polishing solution is formed and in which plural flow passages radially connected to a side face of the solution pan respectively and having a delivery port to supply polishing solution to a position lower than the connected position are formed; a support portion to support the branch body; and a universal joint mechanism to support the branch body via the support portion at a position being higher than the gravity center of the branch body.

According to the present invention, the universal joint mechanism of the polishing solution distribution apparatus supports the branch body via the support portion at the position higher than the gravity center of the branch body. Therefore, even when leveling for installation of the polishing solution distribution apparatus is insufficient or inclination thereof varies after installation, the branch body can be maintained in the leveled posture against the dropping direction of the polishing solution and deviation of distribution quantity of the polishing solution to be distributed to the respective flow passages from the solution pan can be reduced. Further, since the polishing solution smoothly flows through the flow passages, the problem of solidification of particles contained in the polishing solution does not occur.

In the above configuration, the plural flow passages have the same inclination in the flow direction thereof while being connected to the side face at the same height position. Accordingly, the polishing solution can be evenly branched to the respective flow passages.

In the above configuration, a supply portion of polishing solution is arranged above the solution pan and the supply portion supplies polishing solution to the solution pan by dropping polishing solution.

The above configuration further includes plural branch piping formed flexibly being capable of supplying polishing solution to a predetermined position of a polishing mechanism to perform polishing of a polishing object as being respectively connected to delivery ports of the plural flow passages. Accordingly, movement of the branch body is less disturbed by the branch piping and the branch body can be consistently maintained in the leveled posture.

The above configuration further includes a funnel being capable of supplying polishing solution to a predetermined position of a polishing mechanism to perform polishing of a polishing object as being arranged below the delivery port having an opening portion directed upward. Accordingly, the polishing solution can be supplied to the polishing mechanism by utilizing the funnel which does not interfere with movement of the branch piping.

In the above configuration, a deadweight to set a height position of the gravity center of the branch body to be lower than a supported height position of the branch body by the universal joint mechanism may be attached to the branch body. Accordingly, the gravity center of the polishing solution distribution apparatus can be lowered and the leveled posture can be easily maintained.

In the above configuration, a polishing apparatus may include the polishing solution distribution apparatus. Accordingly, the polishing solution distribution apparatus can distribute polishing solution evenly to the polishing apparatus, so that processing accuracy of a workpiece can be improved.

DETAILED DESCRIPTION OF THE PREFERRED EMBODIMENTS

In the following, embodiments of the present invention will be described in detail with reference to the drawings. Here, not limited to the following embodiments, the present invention can be variously modified without departing from the scope of technical concept of the invention described in claims.

Figure 1:
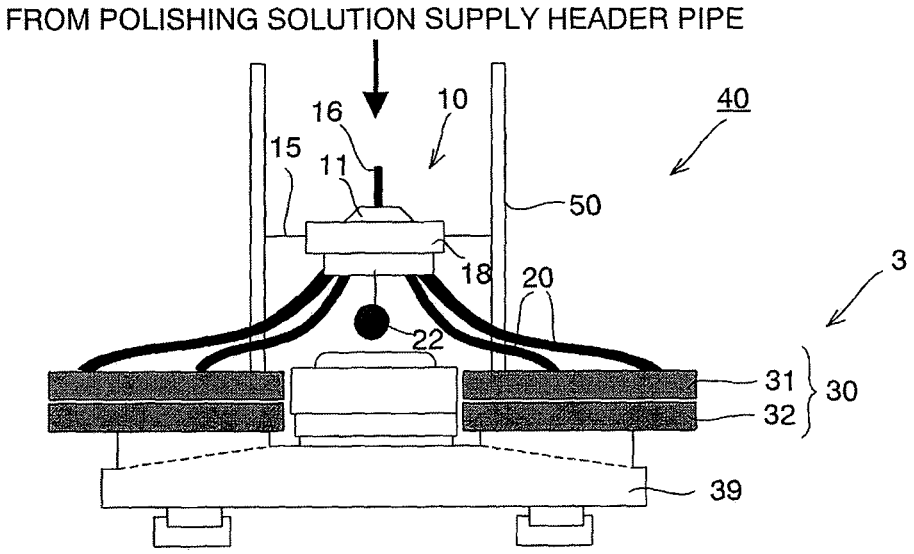
FIG. 1 is a front view of a polishing apparatus according to the first embodiment of the present invention.

FIG. 1 is a front view of a polishing apparatus 40 according to an embodiment of the present invention. As illustrated in FIG. 1, the polishing apparatus 40 is provided with a polishing mechanism 3 to polish a workpiece such as a silicon wafer for a semiconductor and a polishing solution distribution apparatus 10 to supply polishing solution to the polishing mechanism 3. The polishing solution distribution apparatus 10 and the polishing mechanism 3 are connected with branch piping 20. The polishing solution supplied from a polishing solution supply header pipe to the polishing solution distribution apparatus 10 is supplied to the polishing mechanism 3 after passing through the branch piping 20.

Figure 2:
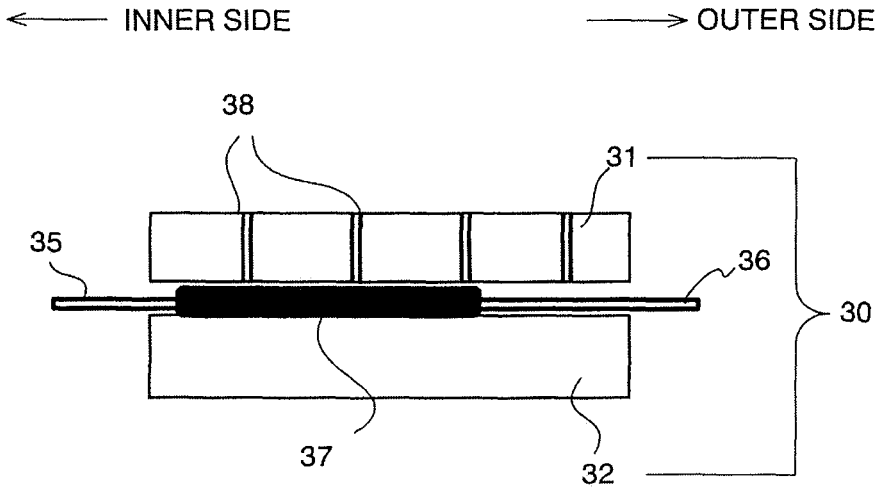
FIG. 2 is an explanatory view of a platen portion of a polishing mechanism according to the present embodiment.

FIG. 2 is an explanatory view of a platen portion of the polishing mechanism 3. The polishing mechanism 3 is provided with an inner gear 35 as a sun gear, an outer gear 36 as an internal gear concentrically arranged at the outside thereof, a carrier 37 which revolves and spins in accordance with rotation of the inner gear 35 and the outer gear 36, and a platen 30 to vertically sandwich a workpiece which is held by the carrier 37. The platen 30 includes a circular upper platen 31 having its center at the position of the inner gear 35 and a circular lower platen 32 arranged below the upper platen 31 as being opposed thereto. The lower platen 32 is placed on a base 39 (see FIG. 1).

The upper platen 31 is hung in a pendulum-like manner via a hanging plate (not illustrated) for hanging of the upper platen 31. The upper platen 31 applies load to a workpiece held by the carrier 37 with a pressure adjusting mechanism (not illustrated) such as an air-cylinder.

The upper platen 31 is provided with plural polishing solution supply holes 38 piercing in the vertical direction. The branch piping 20 (see FIG. 1) is connected to each polishing solution supply hole 38. The polishing solution is supplied, via the respective polishing solution supply holes 38, to a donut-shaped area between the inner gear 35 and the outer gear 36 being sandwiched by the upper platen 31 and the lower platen 32.

Figure 3:
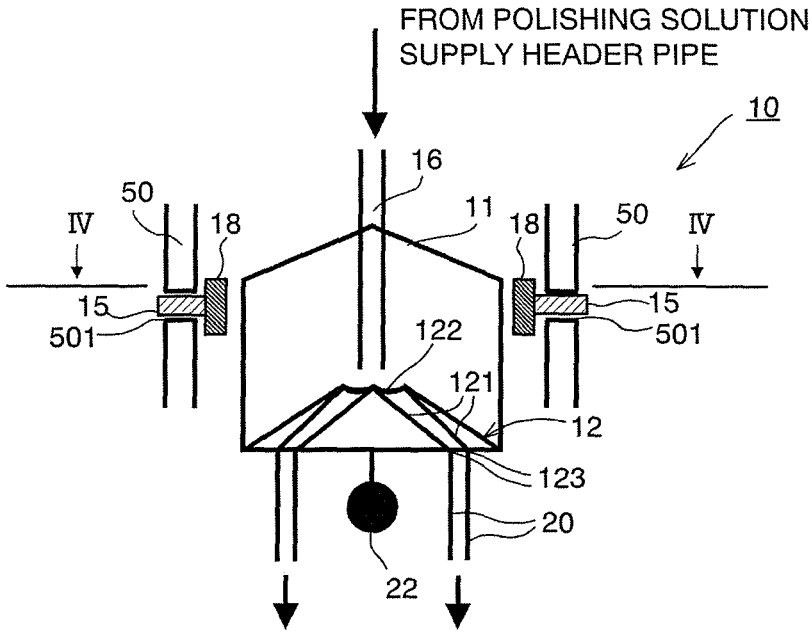
FIG. 3 is a schematic longitudinal sectional view of a polishing solution distribution apparatus and a universal joint mechanism according to the present embodiment.
Figure 4:
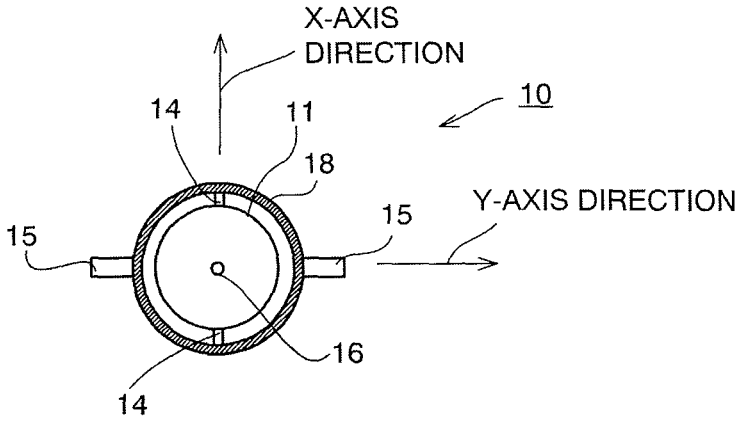
FIG. 4 is a schematic lateral sectional view at line IV-IV of FIG. 3.

FIG. 3 is a schematic longitudinal sectional view of a polishing solution distribution apparatus 10 and a universal joint mechanism. FIG. 4 is a schematic lateral sectional view at line IV-IV of FIG. 3.

As illustrated in these drawings, the outside of the polishing solution distribution apparatus 10 is covered with a cylinder-shaped support portion 11. A top board portion of the support portion 11 is formed mountain-shaped. A pipe-shaped supply portion 16 to drop the polishing solution pierces through the apex portion of the mountain-shape in the vertical direction. The supply portion 16 is formed of soft material such as thin silicone rubber to be flexible so as not to disturb operation of the support portion 11. The polishing solution is supplied to the supply portion 16 from a supply source of the polishing solution (not illustrated) via the polishing solution supply header pipe.

A cone-shaped branch body 12 is arranged at a bottom plate of the support portion 11. A bottom face of the branch body 12 is formed to have the approximately same diameter as that of the support portion 11. A solution pan 122 which temporarily stores the polishing solution is formed at the apex portion of the cone-shape. Plural gutter-shaped flow passages 121 are radially formed from the apex portion of the cone-shape toward a base. An upper end of each flow passage 121 is connected to a side face of the solution pan 122 at the same height position. A delivery port 123 to discharge and supply downward the polishing solution passing through the flow passage 121 is arranged at an intersection position of a lower end of each flow passage 121 and a side wall of the support portion 11.

The branch piping 20 is connected to each delivery port 123. The polishing solution passing through each flow passage 121 is to be supplied downward to the polishing mechanism 3 side via the delivery port 123 and the branch piping 20. The branch piping 20 is formed of soft material such as thin silicone rubber to be flexible so as not to disturb operation of the branch body 12.

Here, it is assumed that a three-dimensional orthogonal coordinate system is defined as Z-axis being the center axis of the support portion 11 (i.e., the longitudinal direction of the supply portion 16 arranged at the support portion 11) and as the origin being a position higher than the gravity center of the branch body 12 in Z-axis. As illustrated in FIG. 4, one end of each first shaft 14, 14 is connected to an outer circumferential face of the support portion 11 in the direction of X-axis. The other end of each first shaft 14, 14 is connected to an inner circumferential face of a ring member 18 of which diameter is size larger than that of the support portion 11 in the direction of X-axis.

Each second shaft 15, 15 is connected to an outer circumferential face of the ring member 18 in the direction of Y-axis. The second shafts 15, 15 are inserted and supported respectively to support holes 501, 501 of support poles 50, 50 which are arranged beside both sides of the support portion 11. The universal joint mechanism is constituted with the first shafts 14, 14, the second shafts 15, 15, the ring member 18, and the support poles 50, 50. Owing to the universal joint mechanism, the support portion 11 can flexibly rotate having X-axis and Y-axis as the rotational axes and the branch body 12 arranged at the bottom plate of the support portion 11 can take any posture in conjunction with movement of the support portion 11. Accordingly, the branch body 12 can be maintained on the level against the vertical direction to be capable of being consistently maintained on the level against the dropping direction of the polishing solution.

A deadweight 22 is hung on the lower portion center of the branch body 12. The deadweight 22 can lower the gravity center of the branch body 12, thereby enabling the branch body 12 to stably maintain a leveled posture. Further, since the range of "the position higher than the gravity center of the branch body 12" is broadened, restriction for attaching positions of the first shafts 14, 14 and the second shafts 15, 15 can be relaxed. Here, the attaching position of the deadweight 22 is not limited to the lower portion center of the branch body 12. For example, the deadweight 22 can be arranged evenly at the circumference of the bottom face of the branch body 12. In the case that the gravity center of the polishing solution distribution apparatus 10 is sufficiently low as a result of forming the branch body 12 with heavy material, for example, the deadweight 22 may not be arranged.

The polishing solution supply header pipe to supply the polishing solution to the supply portion 16 is provided with one flow meter (not illustrated) and one flow quantity adjusting valve (not illustrated) respectively. The flow quantity adjusting valve adjusts the total flow quantity of the polishing solution supplied to the polishing solution distribution apparatus 10.

For performing polishing of a workpiece, plural carriers 37 are placed on the lower platen 32 in a state that the upper platen 31 is raised and a workpiece is mounted to each carrier 37. Next, predetermined load is applied to each workpiece by lowering the upper platen 31. Subsequently, the polishing solution is dropped from the polishing solution supply header pipe to the supply portion 16 of the polishing solution distribution apparatus 10, and then, the lower platen 32 is rotated at predetermined speed while supplying the polishing solution to the area sandwiched by the upper platen 31 and the lower platen 32 via the branch piping 20 connected to the polishing solution distribution apparatus 10. Accordingly, the plural carriers 37 revolve on the circumference of the inner gear 35 while spinning, that is, perform planetary motion.

Since the branch body 12 is supported by the universal joint mechanism at the position higher than the gravity center thereof, the branch body 12 can be consistently maintained in the leveled posture against the dropping direction of the polishing solution during the rotation even when leveling for installation of the polishing solution distribution apparatus 10 is insufficient or inclination of the installation location varies. Accordingly, the branch body 12 is capable of evenly distributing, to the flow passages 121, the polishing solution dropping from the supply portion 16 to the solution pan 122 and evenly supplying to the area between the upper platen 31 and the lower platen 32 via the branch piping 20 and the polishing solution supply holes 38.

Processing accuracy such as shape and thickness of a workpiece can be improved by evenly distributing polishing solution as described above. Further, even in the case of performing processing treatment such as lapping to cause wear of the platen 30, deviation of wear distribution among respective portions of the platen 30 can be improved and frequency of maintenance can be lowered. In the case that deviation of supply quantity of the polishing solution occurs, it is required to excessively supply the polishing solution so as to prevent occurrence of operation out of solution at a portion having less supply quantity. Here, the supply quantity of the polishing solution can be reduced and manufacturing cost can be reduced by evenly supplying the polishing solution.

Further, the total flow quantity can be adjusted only by arranging one flow meter and one flow quantity adjusting valve at one position of the polishing solution supply header pipe without arranging plural valves as a separate valve type in the related art.

In addition, with the polishing solution distribution apparatus 10 according to the present embodiment, flow quantity adjustment can be performed with a simple structure without causing stagnation of polishing solution flow by a sponge body, a spherical body or the like and without utilizing expensive components, complex piping and the like. Further, even when the polishing solution distribution apparatus 10 is installed at a high location, operation for level adjustment becomes unnecessary at the high location. Here, the shape of the branch body 12 is not limited to a cone-shape. It is only required that the shape enables the position of the delivery port 123 to be lower than the position of the solution pan 122. It is also possible to adopt a pyramid-shape or a hemisphere-shape like an inversed bowl. Further, the shape of the flow passages 121 may be spiral. Further, the universal joint mechanism is not limited to the above as long as being a mechanism capable of freely varying posture of the polishing solution distribution apparatus 10 in conjunction with gravity acceleration and centrifugal force. For example, it is also possible to hang the polishing solution distribution apparatus 10 from the upper side with a rope.

Figure 5:
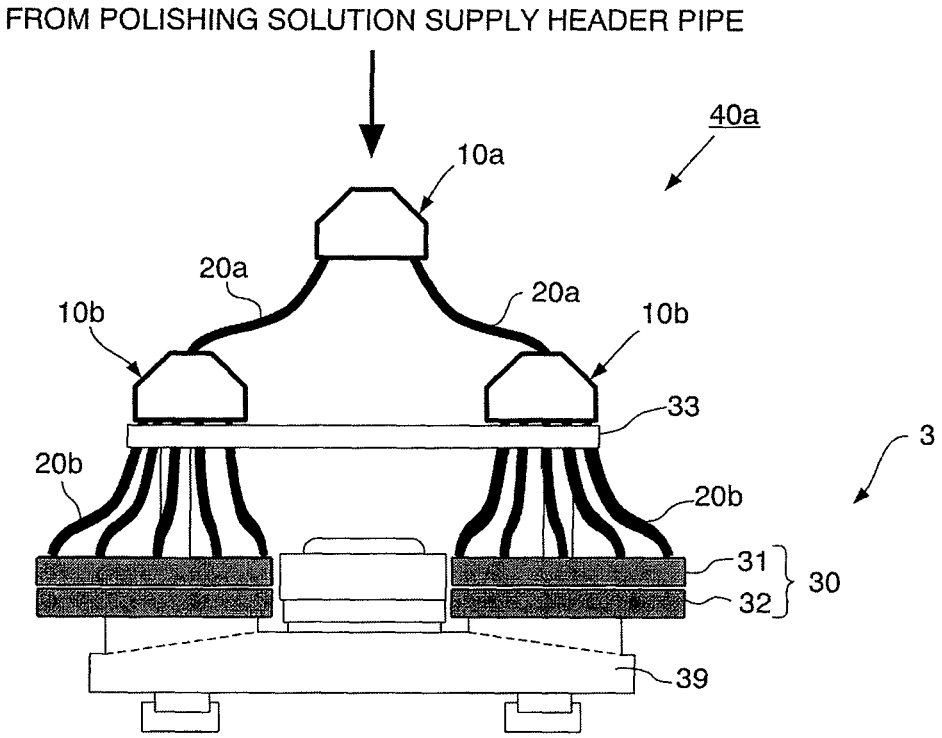
FIG. 5 is a schematic front view of a polishing apparatus according to the second embodiment of the present invention.

Next, the second embodiment will be described with reference to FIG. 5. FIG. 5 is a schematic front view of a polishing apparatus 40*a* according to the present embodiment. In the polishing apparatus 40*a* according to the present embodiment, an upper polishing solution distribution apparatus 10*a* is arranged at an upper stage, plural middle polishing solution distribution apparatuses 10*b* are arranged below the upper polishing solution distribution apparatus 10*a*, and the polishing mechanism 3 is arranged below the middle polishing solution distribution apparatus 10*b*. The upper polishing solution distribution apparatus 10*a* and the middle polishing solution distribution apparatus 10*b* are configured to be similar to the polishing solution distribution apparatus 10 illustrated in FIGS. 3 and 4 as described in the first embodiment. In FIG. 5, the above is illustrated as being simplified.

One end of each branch piping 20*a* is connected to a lower portion of the upper polishing solution distribution apparatus 10*a*. The other end of each branch piping 20*a* is connected to an upper portion of each middle polishing solution distribution apparatus 10*b*. Here, although two strips of the branch piping 20*a* are illustrated in FIG. 5, it is also possible to arrange three or more strips thereof.

One end of each branch piping 20*b* is connected to a lower portion of the middle polishing solution distribution apparatus 10*b*. Each branch piping 20*b* passes through a through hole (not illustrated) arranged at a hanging plate 33 for hanging the upper platen 31 and the other end thereof is connected to the upper platen 31.

In the present embodiment, the polishing solution distributed in the circumferential direction of the platen 30 by the upper polishing solution distribution apparatus 10*a* is further distributed by the plural middle polishing solution distribution apparatuses 10*b* to be distributed and supplied to each portion of a donut-shaped area sandwiched by the upper platen 31 and the lower platen 32.

In the present embodiment being similar to the first embodiment, the branch bodies of the polishing solution distribution apparatuses 10*a*, 10*b* can be consistently maintained in the leveled posture against the dropping direction of the polishing solution without being affected by inclination of the installation location of the polishing solution distribution apparatuses 10*a*, 10*b* as being supported by the universal joint mechanism. Accordingly, the polishing solution can be evenly supplied to the area sandwiched by the upper platen 31 and the lower platen 32.

Figure 6:
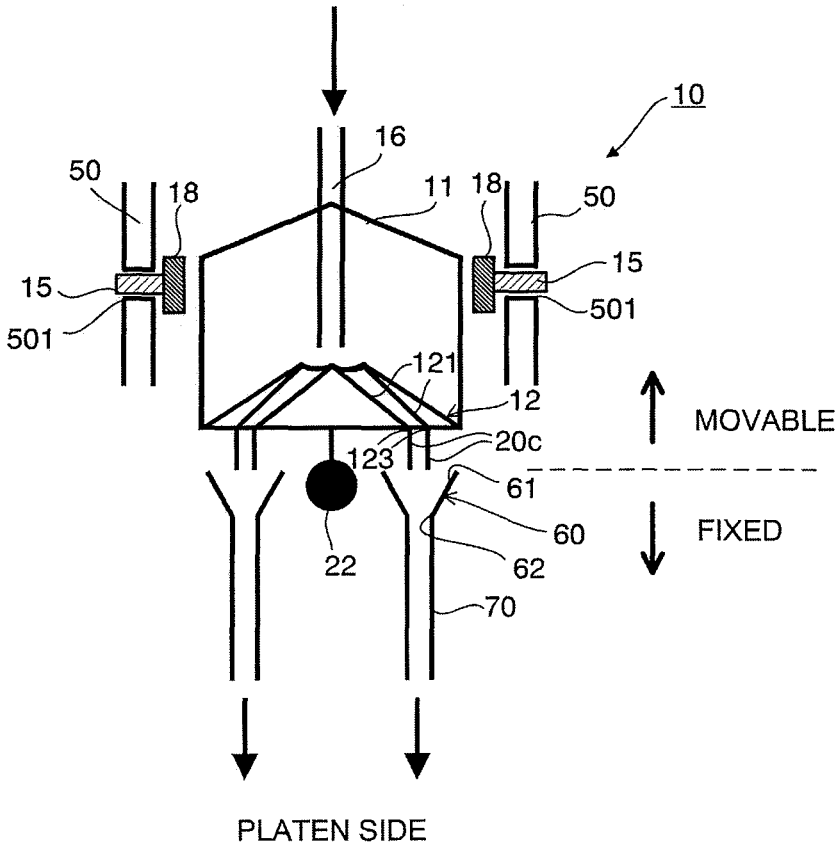
FIG. 6 is an explanatory view of a modified example of branch piping.

FIG. 6 illustrates a modified example of the branch piping 20. As illustrated in FIG. 6, in the case that there is a fear of disturbing movement of the branch body 12 as a result of the large number of the branch piping 20, it is also possible to connect the branch piping 20*c* shorter than the branch piping 20 of the first embodiment to the delivery port 123 of the branch body 12 and to arrange a funnel 60 as directing an upper end opening portion 61 to the upper side below the branch piping 20*c*. Then, a lower end hole 62 of the funnel 60 is connected to piping 70 which is arranged fixedly and the polishing solution is only required to be supplied to a predetermined position of the platen 30 side from the piping 70. With this configuration, movement of the branch body 12 is not disturbed by the branch piping 20*c*. In addition, when the funnel 60 being sufficiently large compared to a movement range of the branch body 12 is arranged, solution leakage from the branch piping 20*c* can be prevented.

Here, it is also possible to arrange the upper end opening portion 61 of the funnel 60 below the delivery port 123 of the flow passage 121 and to supply the polishing solution directly to the funnel 60 from the delivery port 123 without connecting the branch piping 20*c* to the delivery port 123.

The polishing solution distribution apparatus according to the present invention is preferably adopted to a three-way polishing apparatus (including a lapping apparatus) which is constituted with three motional elements being rotating of the lower platen 32, spinning of the carrier 37 and revolving of the carrier 37.

In a four-way polishing apparatus with rotation of the upper platen 31 in addition to the above three motional elements, the polishing solution supplied to the area sandwiched by the upper platen 31 and the lower platen 32 is averaged to some extent by the rotation of the upper platen 31. However, when the rotation of the upper platen 31 is slow or the size of the platen 30 is large, deviation of the distribution quantity is hardly averaged. Therefore, in such a case, it is effective to utilize the polishing solution distribution apparatus for a four-way polishing apparatus.

Improvement of deviation of polishing solution supplying with the polishing solution distribution apparatus is effective especially for a large workpiece and a large platen. For example, it is effective for an apparatus of which workpiece maximum dimension is equal to or larger than 400 mm or of which platen outer diameter is equal to or larger than 1700 mm.

What is claimed is:

1. A polishing solution distribution apparatus, comprising:

a branch body having a solution pan to store polishing solution and plural flow passages radially connected at a position to a side face of the solution pan, respectively, and having a delivery port to supply the polishing solution to a position lower than the connected position; and a support portion unitarily formed with the branch body as an integrated object, the branch body supported at a position higher than the gravity center of the branch body of the support portion by a universal joint mechanism, wherein the universal joint mechanism supports the integrated object by supporting the support portion, the integrated object is arranged at a position in which an upper platen of a polishing mechanism is placed between the integrated object and a lower platen of the polishing mechanism, the universal joint mechanism maintains the integrated object in a horizontal position and allows the integrated object to rotate to move in any direction with respect to the upper platen when polishing a wafer held by the polishing mechanism, wherein the solution pan is positioned on a central axis of the polishing solution distribution apparatus, and wherein the universal joint mechanism is provided at an outer periphery of the branch body with respect to a plan view of the polishing solution distribution apparatus.

2. The polishing solution distribution apparatus according to claim 1, wherein the plural flow passages have the same inclination in the flow direction thereof while connected to the side face at the same height position.

3. The polishing solution distribution apparatus according to claim 1, wherein the supply portion of the polishing solution is arranged at a position higher than the solution pan and the supply portion supplies polishing solution to the solution pan by dropping the polishing solution, and the support portion is supported by the universal joint mechanism.

4. The polishing solution distribution apparatus according to claim 1, wherein a deadweight to set a height position of the gravity center of the branch body to be lower than a supported height position of the branch body by the universal joint mechanism is attached to the branch body.

5. The polishing solution distribution apparatus according to claim 1, further comprising plural branch piping flexibly configured to supply the polishing solution to a predetermined position of the polishing mechanism to perform polishing of a polishing object respectively connected to delivery ports of the plural flow passages.

6. A polishing solution distribution apparatus, comprising:

a branch body having a solution pan to store polishing solution and plural flow passages radially connected at a position to a side face of the solution pan, respectively, and having a delivery port to supply the polishing solution to a position lower than the connected position;

a support portion unitarily formed with the branch body as an integrated object, the branch body supported at a position higher than the gravity center of the branch body of the support portion by a universal joint mechanism; and plural branch piping flexibly configured to supply the polishing solution to a predetermined position of the polishing mechanism to perform polishing of a polishing object respectively connected to delivery ports of the plural flow passages, wherein the universal joint mechanism supports the integrated object by supporting the support portion, the integrated object is arranged at a position in which an upper platen of a polishing mechanism is placed between the integrated object and a lower platen of the polishing mechanism, the universal joint mechanism maintains the integrated object and allows the integrated object to rotate to move in any direction with respect to the upper platen when polishing a wafer held by the polishing mechanism, wherein the solution pan is positioned on a central axis of the polishing solution distribution apparatus, and wherein the universal joint mechanism is provided at an outer periphery of the branch body with respect to a plan view of the polishing solution distribution apparatus.

7. The polishing solution distribution apparatus according to claim 3, further comprising plural branch piping flexibly configured to the supply polishing solution to a predetermined position of the polishing mechanism to perform polishing of a polishing object respectively connected to delivery ports of the plural flow passages.

8. The polishing solution distribution apparatus according to claim 4, further comprising plural branch piping flexibly configured to supply the polishing solution to a predetermined position of the polishing mechanism to perform polishing of a polishing object respectively connected to delivery ports of the plural flow passages.

9. The polishing solution distribution apparatus according to claim 1, further comprising a funnel configured to supply the polishing solution to a predetermined position of the polishing mechanism to perform polishing of a polishing object arranged below the delivery port having an opening portion directed upward.

10. A polishing solution distribution apparatus, comprising:

a branch body having a solution pan to store polishing solution and plural flow passages radially connected at a position to a side face of the solution pan, respectively, and having a delivery port to supply the polishing solution to a position lower than the connected position;

a support portion unitarily formed with the branch body as an integrated object, the branch body supported at a position higher than the gravity center of the branch body of the support portion by a universal joint mechanism; and a funnel configured to the supply polishing solution to a predetermined position of the polishing mechanism to perform polishing of a polishing object arranged below the delivery port having an opening portion directed upward, wherein the universal joint mechanism supports the integrated object by supporting the support portion, the integrated object is arranged at a position in which an upper platen of a polishing mechanism is placed between the integrated object and a lower platen of the polishing mechanism, the universal joint mechanism maintains the integrated object in a horizontal position and allows the integrated object to rotate to move in any direction against with respect to the upper platen when polishing a wafer held by the polishing mechanism, wherein the solution pan is positioned on a central axis of the polishing solution distribution apparatus, and wherein the universal joint mechanism is provided at an outer periphery of the branch body with respect to a plan view of the polishing solution distribution apparatus.

11. The polishing solution distribution apparatus according to claim 3, further comprising a funnel configured to supply the polishing solution to a predetermined position of the polishing mechanism to perform polishing of a polishing object arranged below the delivery port having an opening portion directed upward.

12. The polishing solution distribution apparatus according to claim 4, further comprising a funnel configured to supply the polishing solution to a predetermined position of the polishing mechanism to perform polishing of a polishing object arranged below the delivery port having an opening portion directed upward.

13. The polishing solution distribution apparatus according to claim 5, further comprising a funnel configured to supply the polishing solution to a predetermined position of the polishing mechanism to perform polishing of a polishing object arranged below the branch piping having an opening portion directed upward.

14. The polishing solution distribution apparatus according to claim 6, further comprising a funnel configured to supply the polishing solution to a predetermined position of the polishing mechanism to perform polishing of a polishing object arranged below the branch piping having an opening portion directed upward.

15. The polishing solution distribution apparatus according to claim 7, further comprising a funnel configured to supply the polishing solution to a predetermined position of the polishing mechanism to perform polishing of a polishing object arranged below the branch piping having an opening portion directed upward.

16. The polishing solution distribution apparatus according to claim 8, further comprising a funnel configured to supply the polishing solution to a predetermined position of the polishing mechanism to perform polishing of a polishing object arranged below the branch piping having an opening portion directed upward.

17. A polishing apparatus, comprising:

a polishing solution distribution apparatus, the apparatus comprising:

a branch body having a solution pan to store polishing solution and plural flow passages radially connected at a position to a side face of the solution pan, respectively, and having a delivery port to supply the polishing solution to a position lower than the connected position; and a support portion unitarily formed with the branch body as an integrated object, the branch body supported at a position higher than the gravity center of the branch body of the support portion by a universal joint mechanism, wherein the universal joint mechanism supports the integrated object by supporting the support portion, the integrated object is arranged at a position in which an upper platen of a polishing mechanism is placed between the integrated object and a lower platen of the polishing mechanism, the universal joint mechanism maintains the integrated object and allows the integrated object to rotate to move in any direction with respect to the upper platen when polishing a wafer held by the polishing mechanism, wherein the solution pan is positioned on a central axis of the polishing solution distribution apparatus, and wherein the universal joint mechanism is provided at an outer periphery of the branch body with respect to a plan view of the polishing solution distribution apparatus.

18. The polishing solution distribution apparatus according to claim 1, wherein the upper platen has a polishing solution supply hole protruding in a vertical direction and connected with said integrated object by a flexible branch piping, the polishing solution supply hole connected with said delivery port by said branch piping.

* * * * *